US008839528B2

(12) United States Patent
Ling

(10) Patent No.: US 8,839,528 B2
(45) Date of Patent: Sep. 23, 2014

(54) CONTROLLED NUCLEATION DURING FREEZING STEP OF FREEZE DRYING CYCLE USING PRESSURE DIFFERENTIAL ICE FOG DISTRIBUTION

(75) Inventor: Weijia Ling, Highland, NY (US)

(73) Assignee: Millrock Technology, Inc., Kingston, NY (US)

( * ) Notice: Subject to any disclaimer, the term of this patent is extended or adjusted under 35 U.S.C. 154(b) by 816 days.

(21) Appl. No.: 13/097,219

(22) Filed: Apr. 29, 2011

(65) Prior Publication Data

US 2012/0272544 A1 Nov. 1, 2012

(51) Int. Cl.
*F26B 5/04* (2006.01)
*F26B 21/06* (2006.01)
*F26B 5/06* (2006.01)

(52) U.S. Cl.
CPC ..... *F26B 5/06* (2013.01)
USPC ..... 34/407; 34/559; 34/298

(58) Field of Classification Search
USPC ..... 34/284–301, 402, 403, 406, 407, 559
See application file for complete search history.

(56) References Cited

U.S. PATENT DOCUMENTS 6,630,185 B2 10/2003 Arends et al.
2007/0186567 A1 8/2007 Gasteyer et al.

OTHER PUBLICATIONS

Patel, S. M., et al., "*Reduced Pressure Ice Fog Technique for Controlled Ice Nucleation during Freeze-Drying*," AAPS Pharm. Sci. Tech., vol. 10, No. 4, Dec. 2009, pp. 1406-1411.
Passot, S., et al., "*Effect of Controlled Ice Nucleation on Primary Drying Stage and Protein Recovery in Vials Cooled in a Modified Freeze-Dryer*," Journal of Biomechanical Engineering, vol. 131, Jul. 2009, pp. 074511-1 to 074511-5.

*Primary Examiner* — Kenneth Rinehart
*Assistant Examiner* — John McCormack
(74) *Attorney, Agent, or Firm* — Nixon & Vanderhye, PC

(57) ABSTRACT

A method of controlling and enhancing the nucleation of product in a freeze dryer, wherein the product is maintained at a predetermined temperature and pressure in a chamber of the freeze dryer, and a predetermined volume of ice fog is created in a condenser chamber separate from the product chamber and connected thereto by a vapor port. The ice fog has a predetermined pressure that is greater than that of the product chamber, and is rapidly conveyed through the vapor port into the product chamber for even distribution therein to create uniform and rapid nucleation of the product in different areas of the product chamber.

8 Claims, 1 Drawing Sheet

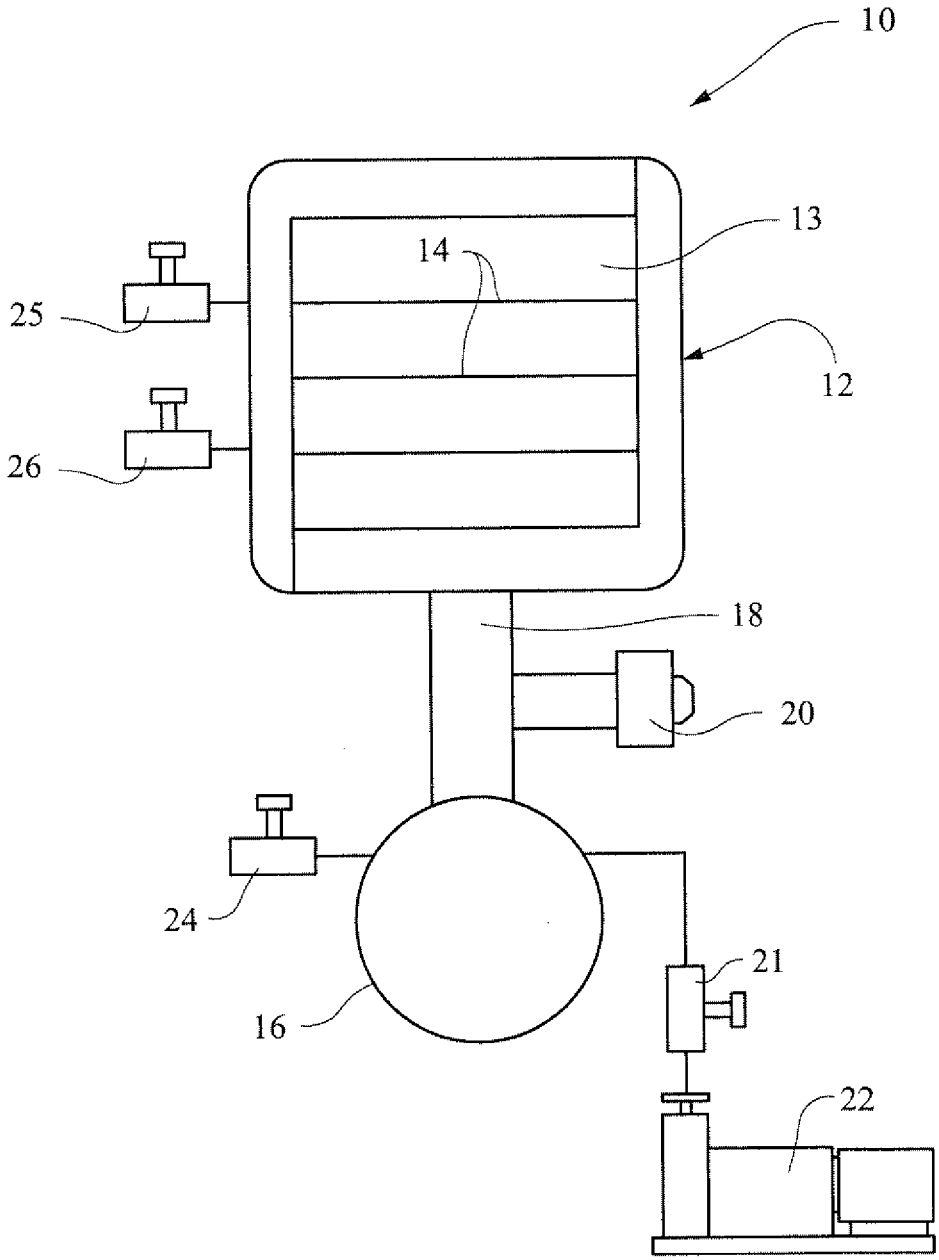
10
13
14
25
12
26
18
20
24
21
16
22

CONTROLLED NUCLEATION DURING FREEZING STEP OF FREEZE DRYING CYCLE USING PRESSURE DIFFERENTIAL ICE FOG DISTRIBUTION

BACKGROUND OF THE INVENTION

1. Field of the Invention

The present invention relates to a method of controlling nucleation during the freezing step of a freeze drying cycle and, more particularity, to such a method that uses a pressure differential ice fog distribution to trigger a spontaneous nucleation among all vials in a freeze drying apparatus at a predetermined nucleation temperature.

2. Description of the Background Art

Controlling the generally random process of nucleation in the freezing stage of a lyophilization or freeze-drying process to both decrease processing time necessary to complete freeze-drying and to increase the product uniformity from vial-to-vial in the finished product would be highly desirable in the art. In a typical pharmaceutical freeze-drying process, multiple vials containing a common aqueous solution are placed on shelves that are cooled, generally at a controlled rate, to low temperatures. The aqueous solution in each vial is cooled below the thermodynamic freezing temperature of the solution and remains in a sub-cooled metastable liquid state until nucleation occurs.

The range of nucleation temperatures across the vials is distributed randomly between a temperature near the thermodynamic freezing temperature and some value significantly (e.g., up to about 30° C.) lower than the thermodynamic freezing temperature. This distribution of nucleation temperatures causes vial-to-vial variation in ice crystal structure and ultimately the physical properties of the lyophilized product. Furthermore, the drying stage of the freeze-drying process must be excessively long to accommodate the range of ice crystal sizes and structures produced by the natural stochastic nucleation phenomenon.

Nucleation is the onset of a phase transition in a small region of a material. For example, the phase transition can be the formation of a crystal from a liquid. The crystallization process (i.e., formation of solid crystals from a solution) often associated with freezing of a solution starts with a nucleation event followed by crystal growth.

Ice crystals can themselves act as nucleating agents for ice formation in sub-cooled aqueous solutions. In the known "ice fog" method, a humid freeze-dryer is filled with a cold gas to produce a vapor suspension of small ice particles. The ice particles are transported into the vials and initiate nucleation when they contact the fluid interface.

The currently used "ice fog" methods do not control the nucleation of multiple vials simultaneously at a controlled time and temperature. In other words, the nucleation event does not occur concurrently or instantaneously within all vials upon introduction of the cold vapor into the freeze-dryer. The ice crystals will take some time to work their way into each of the vials to initiate nucleation, and transport times are likely to be different for vials in different locations within the freeze-dryer. For large scale industrial freeze-dryers, implementation of the "ice fog" method would require system design changes as internal convection devices may be required to assist a more uniform distribution of the "ice fog" throughout the freeze-dryer. When the freeze-dryer shelves are continually cooled, the time difference between when the first vial freezes and the last vial freezes will create a temperature difference between the vials, which will increase the vial-to-vial non-uniformity in freeze-dried products.

A need has arisen, therefore, for an ice fog method that can produce more rapid and uniform freezing of the aqueous solution in all vials in a freeze drying apparatus. The method of the present invention meets this need,

BRIEF SUMMARY OF THE INVENTION

In the new and improved method of the present invention, the ice fog is not formed inside the product chamber by the introduction of a cold gas, e.g., liquid nitrogen chilled gas at −196° C., which utilizes the humidity inside the product chamber to produce the suspension of small ice particles in accordance with known methods in the prior art. These known methods have resulted in increased nucleation time, reduced uniformity of the product in different vials in a freeze drying apparatus, and increased expense and complexity because of the required nitrogen gas chilling apparatus.

In contrast, the present method forms an ice fog external to the product chamber and rapidly introduces the formed ice fog into the chamber to create uniform nucleation of all of the product in different vials in the chamber. The ice fog is formed at atmospheric pressure in a condenser chamber isolated from the product chamber to form a stored volume of ice fog that is then rapidly released into the product chamber which is at a low pressure less then atmospheric pressure, e.g., 50 Torr. The ice fog is distributed evenly across the chamber and into all of the vials for uniform nucleation of the product therein.

BRIEF DESCRIPTION OF THE DRAWINGS

FIG. 1 is a schematic view of one embodiment of apparatus for performing the method of the present invention.

DETAILED DESCRIPTION OF THE INVENTION

As shown in FIG. 1, the apparatus 10 for performing the method of the present invention comprises a freeze dryer 12 having one or more shelves 14 for supporting vials of product to be freeze dried. A condenser chamber 16 is connected to the freeze dryer 12 by a vapor port 18 having an isolation valve 20 of any suitable construction between the condenser chamber 16 and the freeze dryer 12. Preferably, the isolation valve 20 is constructed to seal vacuum both ways.

A vacuum pump 22 is connected to the condenser chamber 16 with a valve 21 therebetween of any suitable construction. The condenser chamber 16 has a release valve 24 of any suitable construction and the freeze dryer 12 has a control valve 25 and release valve 26 of any suitable construction.

As an illustrative example, the operation of the apparatus 10 in accordance with the method of the present invention may be as follows:

1. Cool down the shelf or shelves 14 to a pre-selected temperature (for example −5° C.) for nucleation below freezing point of water enough to super cool the product.

2. Hold the shelf temperature until all of the product probe temperatures are getting very close to the shelf temperature (for example within 0.5° C.).

3. Hold another 10 to 20 minutes for better temperature uniformity across all vials (not shown).

4. With the isolation valve 20 open, open the valve 21 and turn on the vacuum pump 22 to pump down the pressure of the chamber 13 in the freeze dryer 12 and the condenser chamber 16 to a low point which is still above the vapor pressure of water at the product temperature to prevent any bubble formation. (for example 50 Torr)

5. Close the isolation valve 20 between the product chamber 13 and condenser chamber 16, and close the valve 21.

6. Verify condenser temperature is already at its max low usually −53° C. or −85° C.

7. Open the release valve 24 to fill the condenser chamber 16 with moisturized back fill gas all the way to atmosphere pressure.

a. The actual gas type and moisture added to the condenser chamber 16 can vary depending on user preference such that there is sufficient moisture content to generate the ice fog, and is within the knowledge of one skilled in the art. When the moisturized gas fills the cold condenser chamber 16, vapor or water droplets instantly freeze into tiny ice crystals which suspend in the gas forming an ice fog. As an illustrative example, the gas and moisture content added to the condenser chamber 16 may be ambient atmospheric air having 50% to 80% humidity. Also, nitrogen or argon could be used with a sufficient amount of added moisture.

8. Close the release valve 24 on the condenser chamber 16.

9. Open the isolation valve 20 between the product chamber 13 (at low pressure) and the condenser chamber 16 (at atmosphere pressure with ice fog).

a. The ice fog is rapidly injected into the product chamber 13 where it gets distributed evenly across the chamber and into all the vials. The tiny ice crystals serve as nucleation sites for ice crystals to grow in the sub-cooled solution. With the even distribution, all the vials nucleate within a short period of time. The nucleation process of all vials will start from top down and finish within a few seconds.

This method of nucleation is unique by combining an external controllable pre-formation of ice fog with a sudden pressure differential distribution method. This results in a rapid nucleation event, taking seconds instead of minutes, no matter what size of system it is used on. It gives the user precise control of the time and temperature of nucleation and has the following additional advantages:

1. Pre-formation of ice fog in the external condenser chamber 16 is controllable by varying the humidity of the backfill gas. This method allows the amount of ice fog being distributed to be controlled to ensure that there is no excess residual ice fog in the product chamber 13 later.

2. The pressure differential ratio can also be controlled to optimize the distribution of ice seed uniformly across all vials within a few seconds.

3. No local or batch wise temperature change to the product before the actual nucleation allows for precise control of nucleation temperature.

4. The product chamber 13 will remain in a negative pressure, even after introduction of the fog. There is no danger of creating a positive pressure.

5. This method can be used on any sized freeze dryer with an external condenser and an isolation valve 20 without any system modification. Other methods require significant modification or cost.

6. This method can guarantee the sealed sterile operation mode for pharmaceutical production environment application.

7. The advantage of a uniform nucleation method for the application of freeze drying is a uniform crystal structure and large aligned crystals across all of the vials, thus enabling a reduced primary drying process.

From the foregoing description, it will be readily seen that the novel method of the present invention produces an ice fog external to the product chamber in a freeze dryer and then rapidly introduces the fog into the product chamber which is at a pressure much lower than the pressure in the condenser chamber. This method produces rapid and uniform nucleation of the product in different vials of the freeze dryer.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of controlling and enhancing the nucleation of product in a freeze dryer, comprising:

maintaining the product at a predetermined temperature and pressure in a chamber of the freeze dryer;

creating a predetermined volume of ice fog in a condenser chamber separate from the product chamber and connected thereto by a vapor port, the ice fog having a predetermined pressure that is greater than that of the product chamber; and rapidly conveying the ice fog through the vapor port into the product chamber for even distribution therein to create uniform and rapid nucleation of the product in different areas of the product chamber.

2. The method of claim 1 wherein the vapor port has an isolation valve between the product chamber and the condenser chamber to open or close vapor flow therebetween.

3. The method of claim 1 wherein a vacuum pump is connected to the condenser chamber for selectively reducing the pressure within the product chamber and the condenser chamber when the isolation valve is opened.

4. The method of claim 1 wherein the pressure within the product chamber is about 50 Torr and the pressure within the condenser chamber is about atmospheric pressure when the ice fog is rapidly conveyed from the condenser chamber to the product chamber.

5. The method of claim 4 wherein the temperature of the product is about −5.0° C. and the temperature of the condenser chamber is about −53° C. to −85° C. when the ice fog is rapidly conveyed from the condenser chamber to the product chamber.

6. The method of claim 1 wherein a predetermined moisturized back fill gas is introduced into the condenser chamber to produce the ice fog.

7. The method of claim 6 wherein the condenser chamber has a release valve which is opened to enable the moisturized back fill gas to be introduced into the condenser chamber when the temperature of the condenser chamber is about −53 C to −85 C to produce the ice fog.

8. The method of claim 6 wherein the back fill gas is ambient atmospheric air and has a moisture content of about 50-80% by volume.

* * * * *